US006167903B1

(12) United States Patent
Newman

(10) Patent No.: US 6,167,903 B1
(45) Date of Patent: Jan. 2, 2001

(54) FUEL DISPENSER FOR A VEHICLE

(76) Inventor: Stephen E. Newman, 3107 Mariner Dr., League City, TX (US) 77573

( * ) Notice: Under 35 U.S.C. 154(b), the term of this patent shall be extended for 0 days.

(21) Appl. No.: 09/235,259

(22) Filed: Jan. 22, 1999

(51) Int. Cl.[7] ..... F17D 1/08
(52) U.S. Cl. ..... 137/351; 137/572; 123/469
(58) Field of Search ..... 137/351, 572; 123/469, 468

(56) References Cited

U.S. PATENT DOCUMENTS

| | | | | |
|---|---|---|---|---|
| 3,170,495 | * | 2/1965 | Wagner | 137/572 |
| 4,064,901 | * | 12/1977 | Bailey | 137/351 |
| 4,183,498 | | 1/1980 | Hajek, II et al. . | |
| 4,595,030 | | 6/1986 | Yazaki . | |
| 4,860,785 | * | 8/1989 | Sundstrom, Jr. | 137/351 |
| 4,930,537 | | 6/1990 | Farmer . | |
| 5,092,294 | | 3/1992 | Jackson . | |
| 5,360,034 | | 11/1994 | Der Manuelian . | |
| 5,417,239 | | 5/1995 | Ford . | |
| 5,718,260 | * | 2/1998 | Leonardi | 137/355.16 |

* cited by examiner

*Primary Examiner*—John Fox
(74) *Attorney, Agent, or Firm*—Kenneth L. Tolar

(57) ABSTRACT

A fuel dispensing system for a vehicle comprises a manifold assembly having an inlet attachable to a pressure gauge port on a vehicle's fuel line. The inlet is in communication with a pair of outlets, a first of which has an elongated flexible hose attached thereto. The flexible hose includes a nozzle at a distal end through which gasoline may be selectively delivered to an external source. A fuel pressure gauge may be attached to the second outlet, if neccessary. Each outlet includes an internally disposed safety valve means for automatically disabling fuel flow in the event that the fuel gauge or hose become detached therefrom. The hose may be conveniently disposed beneath the vehicle's engine hood when not in use.

6 Claims, 1 Drawing Sheet

FUEL DISPENSER FOR A VEHICLE

BACKGROUND OF THE INVENTION

The present invention relates to a fuel dispensing system attachable to a vehicle fuel line for dispensing gasoline directly to an engine driven external device such as a lawnmower or weed eater.

DESCRIPTION OF THE PRIOR ART

Various household tools such as lawnmowers and weed eaters operate with gasoline powered engines. Accordingly, a small gasoline container must be kept nearby in order to periodically refill the engine's gasoline tank. Because such containers have a limited capacity (usually 5 gallons or less), a user must frequently transport the container to a gasoline station for refilling which is burdensome and inconvenient. Furthermore, when such containers are stored, they often disperse dangerous gasoline fumes throughout a storage facility, significantly increasing the likelihood of fire or explosion. Additionally, vehicles often become stranded roadside when the vehicle's fuel supply is inadvertently exhausted. To aid a stranded driver, another person must transport a portable gasoline container thereto which is dangerous and inconvenient for the reasons described above.

The present invention solves the above enumerated problems by providing a dispensing apparatus attachable to a vehicle's fuel line which allows a user to quickly and conveniently transfer a small quantity of gasoline to an external source. Various fuel tank and transfer systems exist in the prior art. For example, U.S. Pat. No. 5,417,239 issued to Ford relates to a fuel transfer control apparatus for automatically disabling fuel flow from an auxiliary tank to a main tank when the main tank is full. The device is primarily designed for trucks used in the transportation industry.

U.S. Pat. No. 5,360,034 issued to Der Manuelian relates to a dual fuel tank system for a vehicle which allows a main tank to be used independently from or in combination with an auxiliary tank.

U.S. Pat. No. 5,092,294 issued to Jackson relates to a method and apparatus for defueling a vehicle having a fuel tank and fuel pump. The method includes connecting a hose to the fuel system downstream of the fuel tank and electrically connecting the fuel pump to a battery.

U.S. Pat. No. 4,930,537 issued to Farmer relates to a vehicle fuel system for a truck having multiple tanks, an above tank crossover line interconnecting the tanks, a draw line coupled to a primary tank and a return line coupled to the crossover line or to either of the tanks.

U.S. Pat. No. 4,595,030 issued to Yazaki relates to a fuel tank for a water craft including a wall forming a main container and a lateral extension adjacent the bottom of the container. The extension has at least one transparent wall so that a user may visibly detect moisture accumulation.

U.S. Pat. No. 4,193,498 issued to Hajek, II et al relates to a draining apparatus for a fluid reservoir. The device includes a guide housing connected about a fluid reservoir opening and a fluid carrier conduit slidably positioned within the guide housing. The conduit is movable relative to the housing to an extended position for draining the fluid reservoir.

Although various fuel dispensing devices for vehicles exist in the prior art, none relate to a device that is attachable to a vehicle's fuel line for conveniently dispensing fluid to an external source. The present invention includes a manifold means adapted to be coupled with the vehicle's fuel line for dispensing gasoline through an attached hose.

SUMMARY OF THE INVENTION

The present invention relates to a fuel dispenser for use with a vehicle's fuel system to conveniently dispense a predetermined quantity of gasoline to an external source. The device comprises a manifold means having an inlet in communication with a pair of outlets. The inlet is configured to be coupled with a port on the vehicle's fuel line. Each outlet includes an internal safety valve means that allows flow therethrough only when a dispensing hose, a pressure gauge or a similar device is connected thereto. Fluid flow to a first outlet may be further disabled or restricted with a mechanical valve means. The device also includes an elongated, flexible hose member having a coupling member at a first end for coupling the hose with the first outlet on the manifold means. At a distal end of the hose is a nozzle member through which gasoline may be selectively delivered. A conventional fuel gauge may be secured to the other outlet. When not in use, the hose may be conveniently stored beneath the engine hood. To dispense gasoline to an external source, the user activates the ignition, opens the mechanical valve means and dispenses a desired amount of gasoline through the nozzle. It is therefore an object of the present invention to provide a gasoline dispensing system that eliminates the dangerous practice of storing portable gasoline containers.

It is yet another object of the present invention to provide a gasoline dispensing system that eliminates the burdensome practice of frequently refilling a portable gasoline container.

It is yet another object of the present invention to provide a gasoline dispensing system that may be quickly and conveniently installed and stored beneath the engine hood. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
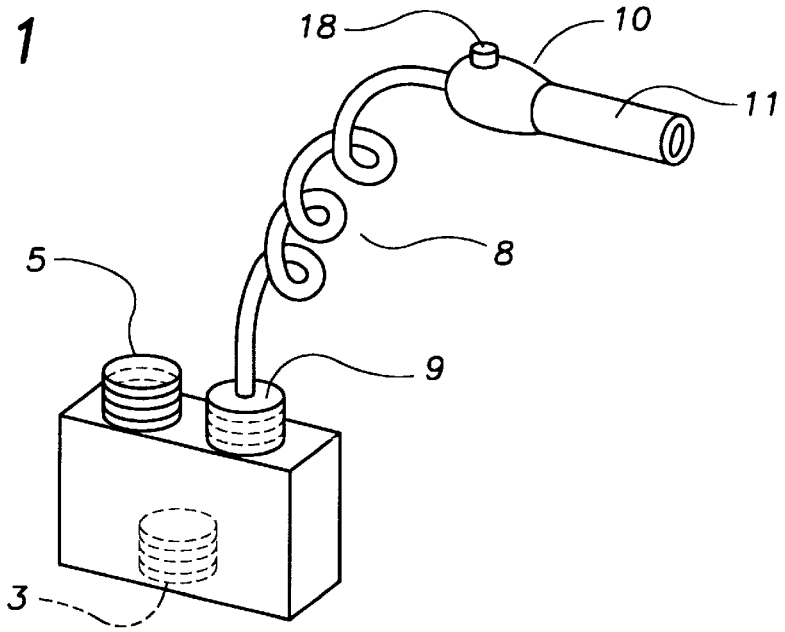
FIG. 1 is a perspective view of the inventive device.
Figure 3:
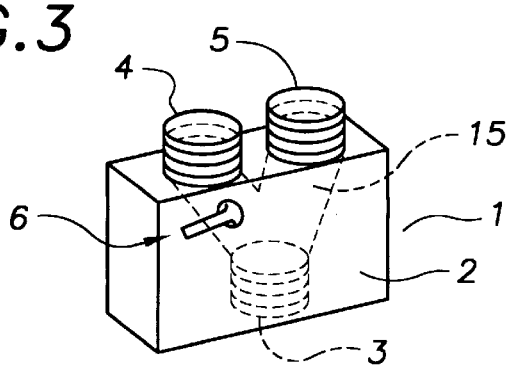
FIG. 3 is a perspective view of the manifold means according to the present invention.

Referring now to FIGS. 1 and 3, the present invention relates to a fuel dispensing assembly for attaching to a vehicle's fuel system. Most vehicles include a fuel line 12 that provides a conduit between the gasoline tank and the engine. Gasoline is delivered to the engine with a fuel pump that is activated upon the ignition being activated. The fuel line typically contains a threaded port 13 to which a pressure gauge valve fitting (not pictured) is typically mounted. The present invention relates to a dispensing system for attaching to the threaded port on a vehicle's fuel line as described above.

The dispensing system according to the present invention comprises a manifold means 1 including a substantially rectangular hollow housing 2 having planar front and rear surfaces, a top edge, a bottom edge and two opposing side edges. On the bottom edge of the housing is an internally threaded inlet 3 for threadedly coupling the manifold means to the fuel line threaded port. The inlet is in fluid communication with a pair of outlets 4 and 5 on the top edge of the housing via a "Y" 15, "T" or a similar fitting. Each outlet has a safety valve means received therein including a spring biased member that normally biases the valve towards a closed position to disable flow therethrough. Flow through the outlet is enabled upon the spring biased member being impinged by an engagement member on a conduit, valve, gauge or similar device when coupled with the outlet. The internally disposed safety valve means preferably relates to what is commonly referred to as a Schrader™ valve or any similar device that is normally closed unless the outlet is coupled with a fluid measurement or transfer member. Flow through a first outlet is further disabled or varied with a mechanical valve means operable with a pivotable handle 6 disposed on the front side of the manifold housing.

The dispensing system also includes an elongated flexible hose 8 having a coupling member 9 at a first end thereof for connecting the hose to the first outlet. The coupling member preferably includes an internally disposed engagement member for activating the safety valve means when the coupling member is secured to the outlet. At a distal end of the hose is a dispensing nozzle 10, activated with a depressible, spring biased button 18, through which gasoline may be delivered directly to a gasoline powered tool or to an external container. The nozzle preferably includes an elongated tubular nose 11 dimensioned to be received within a gasoline tank refill opening to minimize spillage during fuel transfer.

Figure 2:
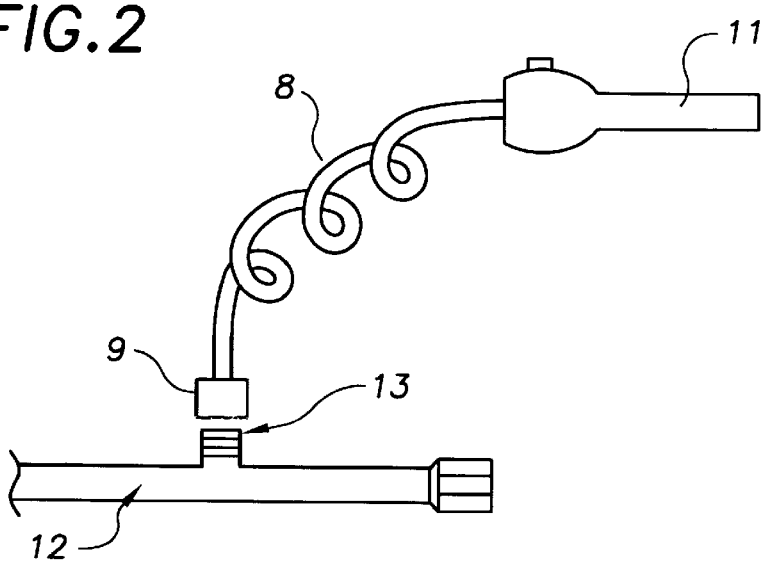
FIG. 2 is a perspective view of the flexible hose member attached directly to a vehicle's fuel line.

To use the above described device, the manifold means inlet is coupled with the fuel line port. The hose is attached to the first outlet and is coiled and secured in a convenient location beneath the engine hood. A conventional fuel gauge may be secured to the second outlet if desired. To dispense gasoline to an external source, a user activates the ignition (preferably without actually starting the engine) to activate the fuel pump and opens the mechanical valve means. A desired quantity of gasoline may then be conveniently dispensed through the dispensing nozzle by depressing the button. In addition, the hose may be used with the manifold means or may be coupled directly with the fuel line as depicted in FIG. 2.

The manifold assembly and the valve means handle are preferably constructed with metal such as steel or stainless steel. The hose is preferably constructed with rubber while the dispensing nozzle is preferably constructed with plastic or a similar equivalent. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a vehicle fuel line having an externally disposed port in communication with said fuel line, a fuel dispensing system comprising:

a manifold having an inlet in fluid communication with a first outlet, said inlet adapted to be removably mounted to said fuel line port;

an elongated flexible hose attached to said outlet, said hose having a dispensing nozzle at a distal end through which gasoline is selectively delivered from said fuel line to an external source;

a second outlet in communication with said inlet to which an external instrument is attached.

2. A fuel dispensing system according to claim 1 wherein said manifold further includes a mechanical valve for selectively disabling fuel flow to said first outlet.

3. A fuel dispensing system according to claim 1 wherein said first and second outlets each include a safety valve disposed therein, said valves normally biased in a closed position, each valve automatically moving to an open position upon either of said hose and said instrument being attached to either of said outlets.

4. A fuel dispensing system according to claim 1 wherein said nozzle further comprises an elongated nose dimensioned to be inserted into a refill opening of a fuel tank to minimize spillage during transfer of fuel thereto.

5. A fuel dispensing system according to claim 1 wherein said nozzle further includes a depressible, spring biased button for activating an internally disposed valve to dispense fuel therethrough.

6. A fuel dispensing system according to claim 1 further comprising:

a normally closed safety valve disposed within each of said outlets;

a coupling attached to a distal end of said hose, said coupling having an internally disposed engagement member for opening said safety valve upon said coupling being attached to either of said outlets.

* * * * *